United States Patent [19]

Koon

[11] 4,409,043

[45] Oct. 11, 1983

[54] AMORPHOUS TRANSITION METAL-LANTHANIDE ALLOYS

[75] Inventor: Norman C. Koon, Woodbridge, Va.

[73] Assignee: The United States of America as represented by the Secretary of the Navy, Washington, D.C.

[21] Appl. No.: 314,326

[22] Filed: Oct. 23, 1981

[51] Int. Cl.[3] ..... C22C 19/00

[52] U.S. Cl. ..... 148/403; 420/435; 420/581; 75/123 B; 75/123 E; 75/124

[58] Field of Search ..... 75/123 B, 123 E, 123 F, 75/123 A, 123 N, 123 K, 123 L, 124 R, 124 B, 124 C, 124 E, 124 F, 134 N, 134 B, 134 F, 134 T, 134 M, 134 S, 134 P, 170; 420/435, 416, 455, 440, 580, 581, 588; 148/403, 408, 425

[56] References Cited

U.S. PATENT DOCUMENTS

| | | | |
|---|---|---|---|
| 4,065,330 | 12/1977 | Matsumoto et al. | 148/121 |
| 4,126,494 | 11/1978 | Imamura et al. | 75/123 E |
| 4,134,779 | 1/1979 | Ray et al. | 148/121 |
| 4,226,619 | 10/1980 | Hatta et al. | 75/123 K |
| 4,249,969 | 2/1981 | DeCristofuro et al. | 148/108 |
| 4,264,358 | 4/1981 | Johnson et al. | 75/134 F |
| 4,290,805 | 9/1981 | Gorgerino et al. | 75/134 S |

FOREIGN PATENT DOCUMENTS

| | | |
|---|---|---|
| 51-73923 | 6/1976 | Japan . |
| 56-41345 | 4/1981 | Japan . |
| 56-72153 | 6/1981 | Japan . |

OTHER PUBLICATIONS

Metallic Glasses, American Society for Metals, 1978, pp. 8 to 13.

*Primary Examiner*—John P. Sheehan

*Attorney, Agent, or Firm*—Robert F. Beers; William T. Ellis; Thomas E. McDonnell

[57] ABSTRACT

An amorphous alloy of iron, boron, lanthanum, and a lanthanide wherein lanthanum and the lanthanide comprise up to 15 atomic percent of the alloy is obtained by rapidly quenching the molten alloy. The amorphous alloy is useful as a soft magnetic alloy.

20 Claims, 2 Drawing Figures

AMORPHOUS TRANSITION METAL-LANTHANIDE ALLOYS

BACKGROUND OF THE INVENTION

The present invention pertains generally to alloys and in particular to magnetic iron-boron alloys.

Iron alloys, including iron-boron alloys, have been used extensively as magnets, both soft and hard. A hard magnetic alloy is one with a high coercive force and remanence, whereas a soft magnetic alloy is one with a minimum coercive force and minimum area enclosed by the hysteresis curve. Examples of iron-boron alloys suitable as magnets are found in U.S. Pat. Nos. 4,134,779, 4,226,619; and 4,249,969.

Magnetic ferrous alloys with some members of the lanthanide series are known, for example, the alloys of U.S. Pat. No. 4,065,330. Two amorphous, iron-rare earth alloys are known to exhibit hard magnetic properties at room temperature. In A. E. Clark *Applied Phys. Letter* 23, 642 (1973), an amorphous $TbFe_2$ alloy, produced by rapid sputtering, is reported to develop a coercive force of 3.4 kOe at room temperature. Amorphous Pr-Fe alloys, produced by melt spinning, have been shown in J. J. Croat *Appl. Phys. Letter* 37, 1096 (1980) to have coercive forces up to 2.8 kOe. Also, intermetallic compounds of iron and certain lanthanides have been used as magnetostrictive materials. Examples of these compounds are disclosed in Koon et al. Phys. Lett. 34A 5, p. 413 (1971). However, no iron-lanthanum alloys have been prepared because of the instability of the combination.

Alloying iron, boron, and a lanthanide to produce an alloy with a microstructure giving excellent magnetic or magnetostrictive properties has also not been successful. An amorphous microstructure is particularly appealing and has received a great deal of attention in recent years, mainly because of their potential for use in high-performance, low-loss transformers. The attractiveness of amorphous alloys for such application is due, in part, to the fact that a material that lacks a regular crystal structure cannot have conventional magnetic anisotropy. Because amorphous alloys combine low magnetic anisotropy with a very uniform microstructure, they are generally very easy to magnetize, often requiring only fractions of an Oersted to achieve almost complete saturation. Unfortunately attempts to produce amorphous iron-boron-lanthanide alloys have not been successful. Instead of obtaining an amorphous alloy, an intermetallic compound is obtained.

SUMMARY OF THE INVENTION

It is, therefore, an object of this invention to provide a class of amorphous alloys which have excellent soft-magnetic properties.

Another object is to propare soft magnets inexpensively and quickly.

And another object of this invention is to prepare soft magnets by a method permitting a wide range in the characteristics of the product.

Yet another object of the present invention is to prepare a soft magnet with either no or nearly no magnetostriction or with a large magnetostriction.

A further object of this invention is to prepare alloys which can be processed into permanent magnets.

A still further object of this invention is to prepare amorphous alloys comprising iron, boron, and lanthanides.

These and other objects are achieved by alloying iron and boron with lanthanum and a lanthanide and melt-quenching the molten alloy.

DETAILED DESCRIPTION OF THE INVENTION

Figure 1:
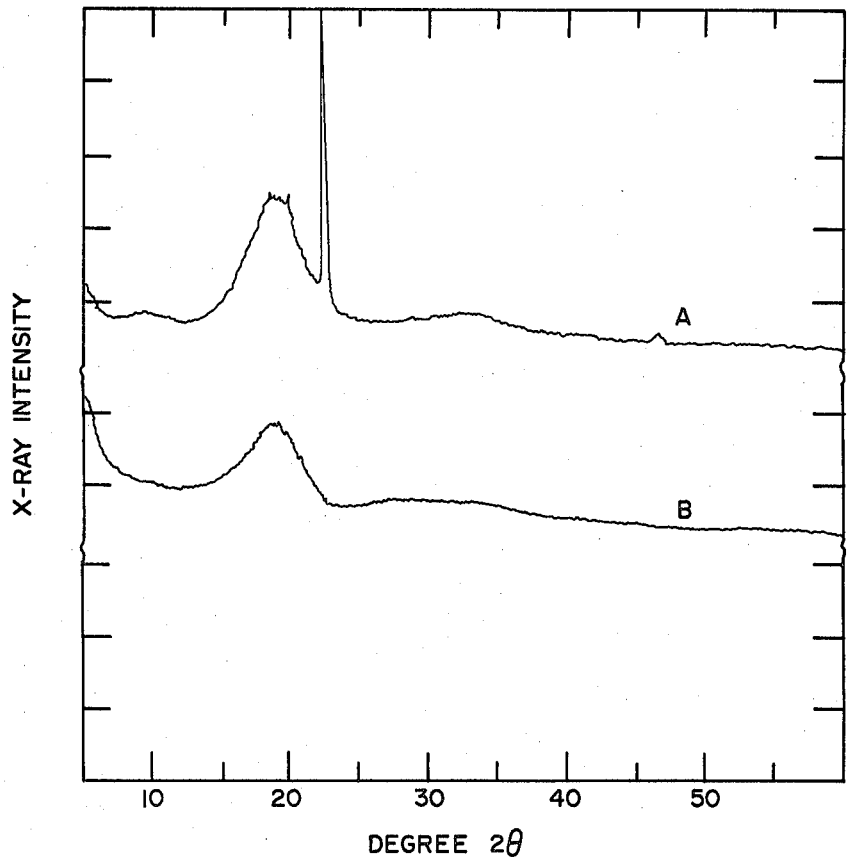
FIG. 1 shows x-ray diffraction data from the top surface of two alloys, one of this invention and one without lanthanum.

The amorphous alloys of the present invention are represented by the formula:

$(M_wX_xB_{1-w-x})_{1-y}(R_zLa_{1-z})_y$ wherein w is from about 0.7 to about 0.9; x is from 0 to about 0.10; y is from about 0.05 to about 0.15; z is from 0 to about 0.95; M is selected from the class consisting of iron, cobalt, an iron-cobalt alloy, an iron-manganese alloy having at least 50 atomic percent iron, an iron-nickel alloy having at least 50 atomic percent iron, an iron-cobalt-manganese alloy having at least 50 atomic percent iron and cobalt, an iron-cobalt-nickel alloy having at least 50 atomic percent iron and cobalt, and an iron-cobalt-manganese-nickel alloy having at least 50 atomic percent iron and cobalt; X is an auxillary glass former selected from the class consisting of phosphorous arsenic, germanium, gallium, indium, antimony, bismuth, tin, carbon, silicon, and aluminum; and R is a lanthanide.

It has been determined lanthanum must be present in order to obtain an amorphous alloy comprising iron, boron, and the heavier lanthanides in the above amounts.

The lighter lanthanides, i.e., cerium, praeseodymium, and neodymium can be added in an amount up to about two atomic percent without preventing the formation of an amorphous microstructure. Any lanthanide or mixture of lanthanides can produce a useful soft magnet, but some are not likely to be used on account of expense or being difficult to process. Those lanthanides are europrium, gadolinum, ytterbium, and lutetium. An iron-boron alloy with only lanthanum is also not preferred as a soft magnet.

An important advantage of the alloys of this invention is the possibility of preparing soft magnets with little or no magnetostriction, which increases the coercive force through an interaction with imperfections in the alloy. If lanthanides with negative magnetostriction are alloyed with iron which has a positive magnetostriction, the two magnetostrictions cancel, giving a net magnetostriction of zero or nearly zero. Accordingly, cerium through europium would be suitable with cerium, praseodymium, neodymium, and samarium preferred. Due to the magnitude of the negative magnetostriction, cost, and processability, praseodymium and neodymium, samarium are preferred. It should be noted that if a lanthanide with a positive magnetostriction is chosen, a useable magnetostrictive alloy is obtained. The preferred lanthanides of that group are samarium, terbium, dysprosium, holmium, erbium, and mixtures thereof.

The amount of the lanthanide (R) relative to the amount of lanthanum is from 0 to about 0.95. Since the advantageous properties arise from the inclusion of a lanthanides (R) other than lanthanum, an amount less than 0.3 for the lanthanide is not preferred. On the other hand, an amorphous alloy is not generally obtainable without lanthanum; so, alloys with a lanthanide in excess of 0.75 would be difficult to prepare. These alloys would require a large amount of a glass former, a higher amount of boron, and careful processing in order to obtain an amorphous microstructure. The most preferred range for the lanthanide is from 0.4 to 0.75.

Iron is the preferred metal for M. Other elements and alloys can also be used, such as cobalt, iron-cobalt alloys, iron-manganese alloys, and iron-nickel alloys. The preferred value for w is from 0.74 to 0.86 and the most preferred amount is from 0.78 to 0.84. The alloys are represented as:

(1) $Fe_aCO_{l-a}$ wherein a from about 0.01 to about 0.99 and preferably from 0.5 to 0.75;

(2) $Fe_bMn_{l-b}$ wherein b is from about 0.5 to less than about 1.0 and preferably from 0.7 to 0.95; (3) $Fe_cNi_{l-c}$ wherein c is from about 0.5 to less than about 1.0 and preferably from 0.7 to 0.95; (4) $Fe_dCo_eMn_{l-d-e}$ wherein (d+e) is from about 0.5 to less than about 1.0 and preferably from 0.75 to 0.95 and d is greater than e and preferably is more than two times greater than e; (5) $Fe_fCo_gNi_{l-f-g}$ wherein (f+g) is from about 0.65 to less than 1.0 and preferably from 0.8 to 0.95 and f is more than two times greater than g and preferably is more than three times greater; and (6) $Fe_hCo_iMn_jNi_{l-h-i-j}$ wherein (h+i) is from about 0.6 to less than 1.0 and preferably is from 0.7 to 0.95, h is greater than i, and j and (l-h-i-j) are greater than zero.

The auxillary glass formers generally increase the amount of lanthanide which can be included without eliminating the amorphous microstructure. The most common glass formers are phosphorous, silicon, carbon, arsenic, germanium, aluminum, indium, antimony, bismuth, tin, and mixtures thereof. The preferred auxillary glass formers are phosphorus, carbon, silicon, and aluminum. The amount of glass former which can be added is from about 0 to about 0.1 and preferably from about 0 to 0.05.

The amount of lanthanum and lanthanide is from about 0.05 to about 0.15 of the total alloy and preferably is from 0.07 to 0.12. It is possible to form alloys with a lanthanum-lanthanide amount greater than 0.15, depending on the lanthanide, the relative amounts of iron and boron, the presence of a glass former, and the processing parameters. The upper limit of 0.15 represents a general limit, which assures the preparation of an amorphous alloy.

All the amounts of the constituents are expressed in atomic concentration of that constituent and not of the amorphous alloy. Only the expression (y) represents atomic concentration of the total alloy. For an alloy having M represening $Fe_{0.4}Co_{0.3}Mn_{0.2}Ni_{0.1}$ w equaling 0.7, X representing carbon, x equaling 0.1, R representing neodymium, z equaling 0.5, and y equaling 0.1, then formula for the alloy would be $(Fe_{0.4}Co_{0.3}Mn_{0.2}Ni_{0.1})_{0.7}C_{0.1}B_{0.2})_{0.9}(Nd_{0.5}La_{0.5})_{0.1}$ or $Fe_{0.25.2}Co_{0.189}Mn_{0.126}Ni_{0.063}C_{0.09}B_{0.10}Nd_{0.05}La_{0.05}$.

The method of preparation is critical to the formation of the amorphous microstructure. It is critical that after the alloy is formed, the molten alloy is cooled at a rate of at least $5\times10^4$ C/sec and preferably $1\times10^5$ C/sec or greater and most preferably $1\times10^6$ C/sec.

In preparing the alloys of this invention, it is preferred that the starting materials have at least three 9's purity. The starting materials are melted in an inert atmosphere, e.g. vacuum, argon, helium, or other noble gas. Presently only thin sections of the molten alloy can be cooled rapidly enough. Examples of techniques for cooling thin sections include ejecting molten alloy onto a rapidly rotating inert surface, e.g., a highly polished copper wheel, ejecting molten alloy between two counterrotating rollers, vapor deposition or electrolytic deposition on a cold surface. The preferred technique is ejecting the molten alloy onto the surface of a 25-cm., polished, copper wheel rotating at a rate of at least 2000 rev/min.

Having described the invention in general, the following examples are given by way of illustration. It is understood that these examples are given by way of illustration and are not intended to limit this disclosure or the claims to follow in any manner.

I. PREPARATION OF EXAMPLES

Alloys of the examples were prepared by weighing out appropriate amounts of the elemental constituents having a nominal purity of at least 99.9 at %. The constituents were then melted together in an electric arc furnace under an atmosphere of purified Ar. Each ingot was turned and remelted repeatedly to ensure homogeneity.

A portion of each homogenized ingot was placed in a quartz crucible having a diameter of 10–11 mm. and a small orifice at the end of approximate diameter 0.35 mm. The quartz tube was flushed with Ar gas to prevent oxidation during heating. The ingot was then heated to the melting point by an induction furnace, then ejected on to a rapidly rotating copper wheel (2500 rpm) by raising the Ar pressure to about 8 psi. The copper wheel was ten inches in diameter and rotated at an approximate speed of 2500 RPM. The surface of the wheel was polished by using 600 grit emery paper for the final finish. The resulting ribbons were approximately 1 mm in width and 15 microns in thickness.

II TEST PROCEDURE

1. Amorphicity Test

The ribbons were examined for amorphicity by Co and/or Mo X-radiation. Samples were prepared by placing strips of ribbon side by side to form a flat area with either the free surface on the wheel surface of the ribbon exposed to the x-ray beam. This procedure was found to be more stringent than the use of powdered samples since the crystallinity typically observed in these samples was in the form of an oriented phase which formed mainly on the free surface of the ribbon.

2. Magnetization Test

Magnetization measurements were made using a vibrating sample magnetometer, which was first calibrated using a standard nickel sample. The magnetic moment of the alloys were measured by replacing the nickel standard with one of the desired samples and then measuring the moment as a function of applied magnetic field.

III Results

The alloys prepared and tested along with the amorphicity test results are summarized in Table I.

TABLE I

| Alloy | Crystalline | Borderline | Amorphous |
|---|---|---|---|
| $Co_{.82}B_{.18}$ | | | x |
| $Fe_{.82}B_{.18}$ | | | x |
| $Co_{.74}B_{.06}B_{.20}$ | | | x |
| $(Fe_{.82}B_{.18})_{.95}Tb_{.05}$ | x | | |
| $(Co_{.74}Fe_{.06}B_{.20})_{.98}Sm_{.02}$ | x | | |
| $(Fe_{.82}B_{.18})_{.99}Tb_{.01}$ | | x | |
| $(Fe_{.82}B_{.18})_{.99}Sm_{.02}$ | | x | |
| $(Fe_{.82}B_{.18})_{.95}La_{.05}$ | | | x |
| $(Fe_{.82}B_{.18})_{.90}La_{.10}$ | | | x |
| $(Fe_{.82}B_{.18})_{.9}Tb_{.05}La_{.05}$ | | | x |
| $(Fe_{.82}B_{.18})_{.95}Tb_{.03}La_{.02}$ | | | x |
| $(Co_{.74}Fe_{.06}B_{.20})_{.95}Sm_{.02}La_{.03}$ | | | x |
| $(Fe_{.82}B_{.18})_{.93}Tb_{.05}La_{.02}$ | | | x |
| $(Fe_{.85}B_{.15})_{.90}Tb_{.05}La_{.05}$ | | | x |
| $(Fe_{.82}B_{.18})_{.9}D_{y.05}La_{.05}$ | | | x |
| $(Fe_{.82}B_{.18})_{.9}Sm_{.05}La_{.05}$ | | | x |
| $(Fe_{.82}B_{.18})_{.9}Tb_{.05}La_{.05})_{.98}C_{.02}$ | | | x |

As is seen from Table I, especially for the heavy rare earth metals (Gd, Tb, Dy, Ho, Er), the addition of even 1 at. % rare earth to these alloys results in the appearance of crystalline peaks in the x-ray spectrum. The lighter lanthanides can be added in amounts larger than 1 atomic percent before crystallinity is formed. For lanthanum, up to about 15 atomic percent can be added to $Fe_{0.82}B_{0.18}$ without forming crystalline microstructure. A small amount of lanthanum increases the amount of other lanthanides that can be added without observable crystallinity.

The effect of the presence of lanthanum on the x-ray diffraction spectra is shown in FIG. 1 which compares x-ray diffraction spectra of a typical alloy of this invention $(Fe_{0.82}B_{0.18})_{0.9}Tb_{0.05}La_{0.05}$ with the corresponding alloy without lanthanum $(Fe_{0.82}B_{0.18})_{0.95}Tb_{0.05}$ Line (a) shows the diffraction spectrum from the top surface of as-quenched $(Fe_{0.82}B_{0.18})_{0.95}Tb_{0.05}$. The crystalline peak at $2\theta \approx 23°$ is about seven times as intense as the amorphous peak, and remains clearly observable at Tb concentrations down to 1 at .%. X-ray and TEM studies have shown that the crystalline component is due to an oriented phase which forms mainly near the free surface, suggesting surface dominated nucleation. Comparable spectra from the wheel side of the ribbon showed no evidence of crystallinity.

Figure 2:
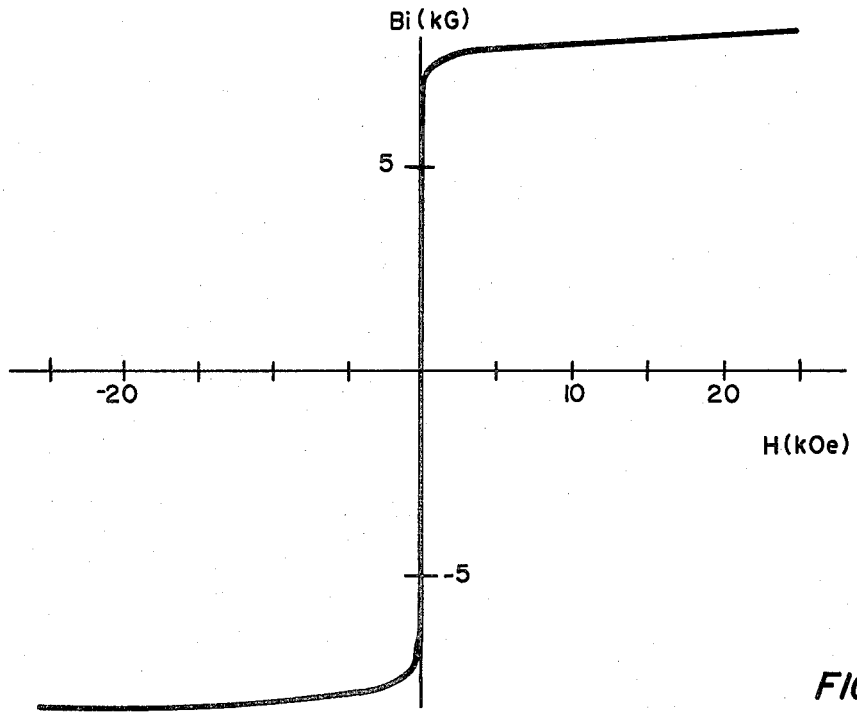
FIG. 2 shows intrinsic magnetization ($B_i$) of $(Fe_{0.82}B_{18})_{0.9}Tb_{0.05}La_{0.05}$.

A comparable alloy having the composition $(Fe_{0.82}B_{0.18})_{0.9}Tb_{0.05}La_{0.05}$, however, appears completely amorphous on both the top and bottom, as shown in Line B for the top surface. FIG. 2 compares the magnetization curve of $(Fe_{0.82}B_{0.18})_{0.9}Tb_xLa_{0.1-x}$ alloys and suggests that $m = \langle J^z \rangle_{Tb}/J_{Tb} \approx 0.6$ at 300 K, implying relatively strong exchange coupling between the rare earth and the iron. The Curie temperature of the amorphous alloy is about 500 K.

The data indicate that the amorphous alloys of this invention have excellent soft magnetic properties. This conclusion is further supported by the low coercive force (<2 Oe) of the alloys. These properties, coupled with the relative low cost of the materials, make the alloys of this invention excellent magnets for low-loss, high-energy transformers and similar applications.

Obviously, numerous modifications and variations of the present invention are possible in light of the above teachings. It is therefore to be understood that within the scope of the appended claims, the invention may be practiced otherwise than as specifically described herein.

What is claimed is:

1. An alloy represented by the formula: $(M_wX_xB_{l-w-x})_{l-y}(R_zLa_{l-z})_y$ wherein w is from about 0.7 to about 0.9; x is from 0 to about 0.10; y is from about 0.05 to about 0.15; z is from 0 to about 0.95; M is selected from the class consisting of iron, cobalt, an iron-cobalt alloy, an iron-manganese alloy having at least 50 atomic percent iron, an iron-nickel alloy having at least 50 atomic percent iron, an iron-cobalt-manganese alloy having at least 50 atomic percent iron and cobalt, an iron-cobalt-nickel alloy having at least 50 atomic percent iron and cobalt, and an iron-cobalt-manganese-nickel alloy having at least 50 atomic percent iron and cobalt; X is an auxiliary glass former selected from the class consisting of phosphorous, carbon, silicon, aluminum, arsenic, germanium, indium, antimony, bismuth, tin, and mixtures thereof, and R is selected from the group consisting of cerium, praseodymium, neodymium, and mixtures thereof, said alloy having an amorphous microstructure.

2. The alloy of claim 1 wherein M is iron.

3. The alloy of claim 2 wherein R is selected from the class consisting of praesodymium neodymium, and mixtures thereof and z is from 0.4 to 0.75.

4. The alloy of claim 2 wherein w is from 0.74 to 0.86.

5. The alloy of claim 4 wherein w is from 0.78 to 0.84.

6. The alloy of claim 2 wherein z is from 0.30 to 0.75.

7. The alloy of claim 6 wherein z is from 0.4 to 0.75.

8. The alloy of claim 6 wherein x is 0 and y is from 0.08 to 0.12.

9. The alloy of claim 1 wherein M is cobalt.

10. The alloy of claim 1 wherein M represents $Fe_aCo_{l-a}$ and a is from about 0.01 to about 0.99.

11. The alloy of claim 1 wherein M represents the formula $Fe_bMn_{l-b}$ wherein $0.5 \leqq b \leqq 1.0$.

12. The alloy of claim 11 wherein $0.7 \leqq b \leqq 0.95$.

13. The alloy of claim 1 wherein M represents $Fe_cNi_{l-c}$ wherein $0.5 \leqq c < 1.0$.

14. The alloy of claim 13 wherein $0.7 \leqq c \leqq 0.95$.

15. The alloy of claim 1 wherein M represents $Fe_dCo_eMn_{l-d-e}$ wherein $0.5 < (d+e) < 1.0$ and $d > e$.

16. The alloy of claim 15 wherein $0.75 \leqq (d+e) \leqq 0.95$ and $d > 2e$.

17. The alloy of claim 1 wherein M represents $Fe_fCo_gNi_{l-f-g}$ and $0.65 \leqq (f+g) \leqq 1.0$ and $f > 2g$.

18. The alloy of claim 17 wherein $0.8 \leqq (f+g) \leqq 0.95$ and $f > 3g$.

19. The alloy of claim 1 wherein M represents $Fe_hCo_iMn_jNi_{l-h-i-j}$ and $0.6 \leqq (h+i) \leqq 1.0$ and $h > i$ and j and (l-h-i-j) are greater than zero.

20. The alloy of claim 14 wherein $0.7 \leqq (h+i) \leqq 0.95$.

* * * * *